US007331479B2

(12) United States Patent
Oh

(10) Patent No.: US 7,331,479 B2
(45) Date of Patent: Feb. 19, 2008

(54) CHILD RESISTANT CONTAINER AND CAP

(75) Inventor: Jack S. Oh, Buena Park, CA (US)

(73) Assignee: Rexam Delta Inc., Hot Springs, AR (US)

( * ) Notice: Subject to any disclaimer, the term of this patent is extended or adjusted under 35 U.S.C. 154(b) by 417 days.

(21) Appl. No.: 10/834,691

(22) Filed: Apr. 29, 2004

(65) Prior Publication Data

US 2005/0242055 A1 Nov. 3, 2005

(51) Int. Cl.
*B65D 41/06* (2006.01)

(52) U.S. Cl. ..... 215/332; 215/331; 215/222; 220/296; 220/300

(58) Field of Classification Search ..... 215/44, 215/43, 330–332, 217, 222; 220/296, 298, 220/300

See application file for complete search history.

(56) References Cited

U.S. PATENT DOCUMENTS

| | | | | |
|---|---|---|---|---|
| 1,887,700 | A | 11/1932 | Stevens | |
| 2,776,066 | A | 1/1957 | Thornton | |
| 3,339,770 | A | 9/1967 | Weigand | |
| 3,344,942 | A | 10/1967 | Hedgewick | |
| 3,435,978 | A * | 4/1969 | Wittwer | 215/217 |
| 3,445,022 | A | 5/1969 | Cilluffo | |
| 3,610,454 | A | 10/1971 | Malick | |
| 3,612,324 | A | 10/1971 | Malick | |
| 3,716,161 | A | 2/1973 | Julian et al. | |
| 3,880,313 | A | 4/1975 | Akers | |
| 3,888,376 | A | 6/1975 | Cooke | |
| 3,951,289 | A | 4/1976 | Landen | |
| 3,952,899 | A | 4/1976 | Cooke | |
| 4,032,028 | A | 6/1977 | Reiss et al. | |
| 4,053,077 | A | 10/1977 | DeFelice | |
| 4,084,716 | A | 4/1978 | Bogert | |
| 4,128,184 | A | 12/1978 | Northup | |
| 4,139,112 | A | 2/1979 | Cooke | |
| 4,223,795 | A | 9/1980 | Akers | |
| 4,320,844 | A | 3/1982 | Cooper | |
| 4,375,858 | A | 3/1983 | Shah et al. | |
| 4,387,817 | A | 6/1983 | Wiles et al. | |
| 4,620,640 | A | 11/1986 | Swartzbaugh | |
| 4,770,308 | A * | 9/1988 | Lynn | 215/330 |
| 5,449,078 | A | 9/1995 | Akers | |
| 6,003,700 | A | 12/1999 | Julian et al. | |
| 6,227,391 | B1 * | 5/2001 | King | 215/307 |
| 6,378,713 | B2 | 4/2002 | Montgomery | |
| 6,523,709 | B2 | 2/2003 | Miceli et al. | |
| 2003/0121877 | A1 | 7/2003 | Brozell et al. | |

* cited by examiner

*Primary Examiner*—Robin A. Hylton
(74) *Attorney, Agent, or Firm*—James E. Cole; Middleton Reutlinger

(57) ABSTRACT

A locking cap and container is provided for a container having an opening surrounded by a neck with container threads thereon that are sized and located to threadingly engage cap threads formed on a skirt of the cap. A shaped distal end is formed on a distal end of the container threads and a barb is formed on the distal end of the cap threads. A resilient locking tab extends from the container, and is located below the shaped distal end and spaced apart from the shaped distal end a distance sufficient to allow passage of the barb beyond the shaped distal end but sufficiently close to resiliently urge the barb into overlapping rotational alignment with the shaped end. The shaped end is configured to lockingly engage the barb when the tab holds them in alignment. Pushing down on the cap pushes the thread against the locking tab and allows disengagement of the barb from the shaped distal end and movement of the barb past the shaped distal end to unlock the cap.

43 Claims, 8 Drawing Sheets

28
34
32
50
36
30
23
24
22
26
46
48
20
3
53
52
54
56
60
58
44
47

CHILD RESISTANT CONTAINER AND CAP

FIELD OF INVENTION

This invention relates to push-and-turn containers and caps that are difficult for children to remove but easy for adults and the elderly to remove.

BACKGROUND OF THE INVENTION

A number of locking mechanisms are used to deter children from gaining access to the contents of containers, such as pharmaceuticals, chemicals, and other items that could be harmful or undesirable for children to consume or ingest. But the locking mechanism must still allow adults and the elderly to open the containers. One type of locking mechanism uses a cap which a person must squeeze to release the lock, and then turn the cap on the container while still squeezing. These squeeze-and-lock mechanisms require strong fingers and good coordination between the squeezing and turning, either of which makes it difficult for seniors to use caps with this type of locking mechanism.

Some containers use a locking mechanism that requires the user to visually align arrows or other indicia and then snap off the container's cap or lid. This type of locking mechanism requires good vision to align the arrows or other indicia, and sufficient finger strength and coordination to force the cap off the container. Each of those also makes it difficult for seniors to use containers and caps with this type of locking mechanism.

Some containers use caps which are pushed down and turned to release a plurality of locks located around the periphery of the cap or the opening to the container. These locking mechanisms do not require the finger strength and coordination of the other locking mechanisms. But they do require strength to push down and release the locking mechanism. These locking mechanisms typically use a resilient disk in the cap that rests against a lip surrounding the opening to the container. When the cap is pushed down against the container lip, the resilient disk is compressed against the lip to allow enough movement to release the lock when the cap is turned. But the cap must be forced against the entire periphery of the lip in order to ensure all of the locking mechanisms around the periphery of the opening are released, and that requires more force than is comfortable or desirable for some seniors. There is thus a need for an improved push-and-turn lock mechanism.

These prior art locking containers and caps are also complex and/or costly to make. The caps were often made of two pieces snapped together or bonded together, or the mating parts of the container and cap required complex molding or expensive after-molding-assembly. This is especially so with prescription vails where the cap is made of two parts and the second pat is a resilient inner piece that is compressed against the cap to provide the resilient locking force. There is thus a need for a container and cap that are simpler to manufacture, and that is preferably cheaper to make.

BRIEF SUMMARY

The present invention reduces the force used to unlock the cap of a container and provides an easily manufactured, unitary cap, and a unitary container. In one embodiment this is achieved by molding the cap, and molding the container, so there are resilient tabs below the trailing end of the container threads and spaced around the periphery of the opening to the container, and then placing a locking member on the cap which goes between the container threads and resilient tab to lock against the trailing end of the container threads. Pushing the cap threads against the resilient tabs allows the locking member to be disengaged when the cap is turned. The tabs can be adjusted to vary the force required to disengage the lock and remove the cap.

There is thus provided a releasable locking cap for a container having an opening surrounded by a neck with at least one container thread thereon that is sized and located to threadingly engage at least one cap thread formed on a skirt of a cap. The cap and container have a shaped distal end on at least one of the cap or container thread and a barb on the other of the at least one cap or container thread. A resilient locking tab extends from the same one of the container and cap as the distal end, the locking tab being located below the shaped distal end and spaced apart from the shaped distal end a distance sufficient to allow passage of the barb beyond the shaped distal end but sufficiently close to resiliently urge the barb into overlapping rotational alignment with the shaped end. The shaped end is configured to lockingly engage the barb.

In further variations the at least one thread is concentric with a central axis of the opening. The locking tab advantageously extends in a plane orthogonal to that axis. Additionally, the locking tab is preferably located below the at least one distal end a distance slightly less than a root width of the at least one thread which contains the barb and measured at a location just trailing an end of the barb. The barb is advantageously, but optionally at an end of the at least one thread on which the barb is formed. The shaped engaging surface is advantageously, but optionally at a corresponding end of the at least one thread on which the shaped engaging surface is located.

The parts can be on either the cap or container, and on the inside or outside. Thus, the barb can be located on the at least one cap thread in which case the shaped distal end is located on the at least one container thread, and the resilient tab is located on the container. Similarly, the barb can be located on the at least one cap thread on the inside of the skirt, in which case the shaped distal end is located on the at least one container thread on an exterior of the container, and the resilient tab is located on the exterior of the container. Likewise, the barb can be located on the at least one cap thread on the outside of the skirt, in which case the shaped distal end is located on the at least one container thread on an inside surface of the container, and the resilient tab is located on an inside surface of the container.

The barb is preferably, but optionally located on a distal end of the at least one cap thread and the shaped distal end is located on the container threads, and the resilient tab is located on the container. Moreover, the threads are preferably concentric with a central axis of the opening and the locking tab extends in a plane orthogonal to that axis. Further, an end of the locking tab advantageously ends in substantial alignment with the distal locking end. When the locking tab is on the container this preferably corresponds to the trailing end of the container thread.

The locking container and/or cap advantageously has the barb and shaped distal end abut along a surface orthogonal to a longitudinal thread axis. But the barb and shaped distal end can also abut along a surface inclined relative to a longitudinal thread axis, with the angle of inclination being selected to cause the shaped distal end to further engage the barb. Further, while there is at least one thread, there are preferably a plurality of cap and container threads.

In a further embodiment there is advantageously provided a releasable locking container and/or cap that has first means formed on an end of the at least one of the cap or container thread and second means formed on an end of the other of the at least one cap or container thread, for forming a lock restraining rotation of the cap in one direction when the means are aligned. This further embodiment also has a resilient locking tab extending from the same one of the container and cap as the first means, with the locking tab being located below the first means and spaced apart from the first means a distance sufficient to allow passage of the second means beyond the first means but sufficiently close to resiliently urge the second means into overlapping rotational alignment with the first means.

In further variations of this further embodiment the first means is on the cap, or it could be on the container. Advantageously, the first and second means comprise abutting surfaces orthogonal to a thread axis along a crest of the at least one thread on which one of the first and second means is located. But the first and second means could also comprise abutting surfaces inclined at an angle to a thread axis along a crest of the thread on which one of the first and second means is located. The inclined angle is preferably selected to cause the first means to further engage the second means. In further variations, the first and second means are at or adjacent to the leading end of the threads on which they are formed, and in other variations one is on a leading end and the other is on a trailing end of the threads on which the respective means are formed.

There is also advantageously provided a method for releasably locking a cap on a container having an opening surrounded by a neck with at least one container thread thereon that is sized and located to threadingly engage at least one cap thread formed on a skirt of the cap. The method includes providing one of the cap or container threads with an upwardly extending barb, preferably but optionally, adjacent a leading end of the thread. The other of the cap or container threads is provided with a locking distal end, preferably but optionally, at a trailing end of the thread, although in other less preferred embodiments it is adjacent the leading end. The method also includes engaging the at least one cap and container threads and providing relative rotation in a first direction between the cap and body to tighten the cap on the container while advancing the barb below the distal end. Finally, the method advantageously includes resiliently urging the barb upward into overlapping alignment with the distal end a distance sufficient that the barb and distal end engage if the direction of the relative rotation is reversed.

Advantageously, but optionally, the resilient urging is provided by a resilient locking tab extending from the same one of the container and cap as the distal end. The locking tab is located below the distal end, with the barb advancing between the distal end and the locking tab when the barb is advanced in the first direction.

The locking tab, barb and shaped end can be located on either the cap or container. Thus, there is provided a releasable locking cap or container having a shaped end on at least one of the cap or container thread and a barb on the other of the at least one cap or container thread. Advantageously, but optionally, the barb is on a leading end of the thread. Further, a resilient locking tab preferably extends from one of the cap or container, with the locking tab being spaced apart from the shaped end a distance sufficient to allow passage of the barb beyond the shaped end but sufficiently close to resiliently urge the barb into overlapping rotational alignment with the shaped end. The shaped end is configured to lockingly engage the barb. The barb can be on the container or on the cap. The shaped end can be on the container or the cap, and is typically on the trailing end of the thread, but could be intermediate the ends of the thread. The locking tab could be on the container or cap, anywhere along the length of the thread, or between adjacent parallel threads, but is preferably adjacent the barb.

In further variations the method includes locating the barb on the cap and locating the distal end on the container. Alternatively, the barb and locking tab are located on the container and the distal end is located on the cap. The method can further include pushing down on the cap to move the barb downward against the locking tab a distance to move the barb and distal end out of alignment so the barb can pass below the distal end and along a bottom of the thread on which the distal end is provided. Further, the method includes providing relative rotation between the cap and container to move the barb in a direction opposite the first direction so the barb.

BRIEF DESCRIPTION OF THE DRAWINGS

These as well as other features of the present invention will become more apparent upon reference to the drawings, in which like numbers refer to like parts throughout, and in which.

DETAILED DESCRIPTION

Figure 2:
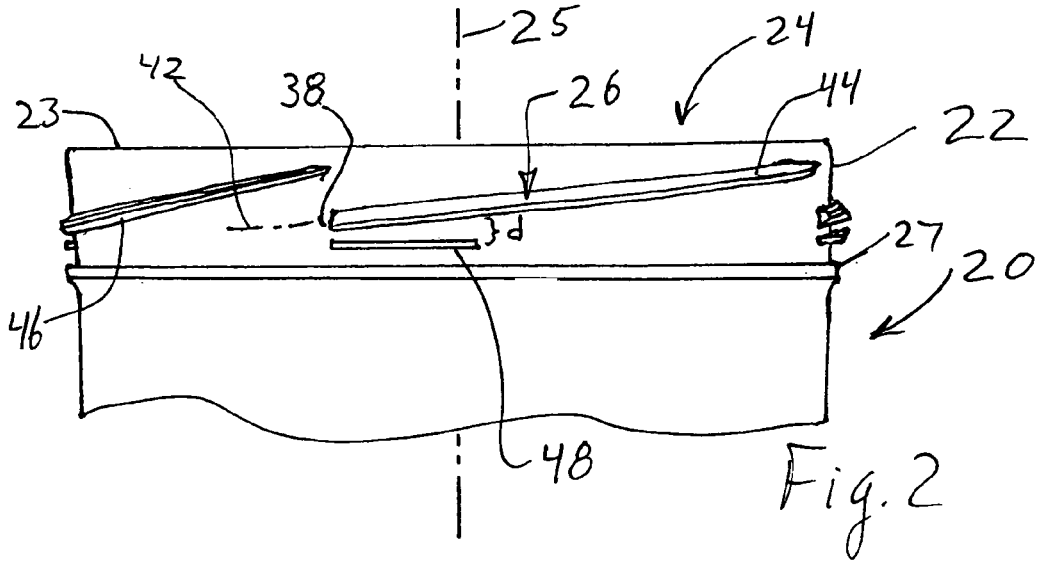
FIG. 2 is a side view of a container with a thread and locking tab for use with the cap of FIG. 1.
Figure 3:
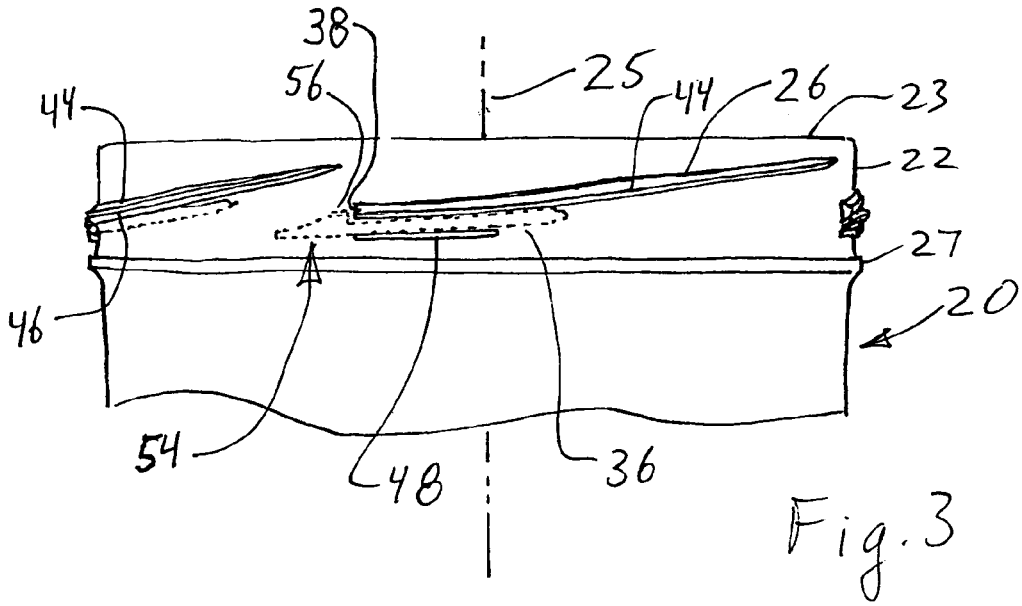
FIG. 3 is a side view of the container of FIG. 2, with the locking member of FIG. 1 engaging the thread and locking tab of FIG. 2.
Figures 4, 5, 6, 7, 8:
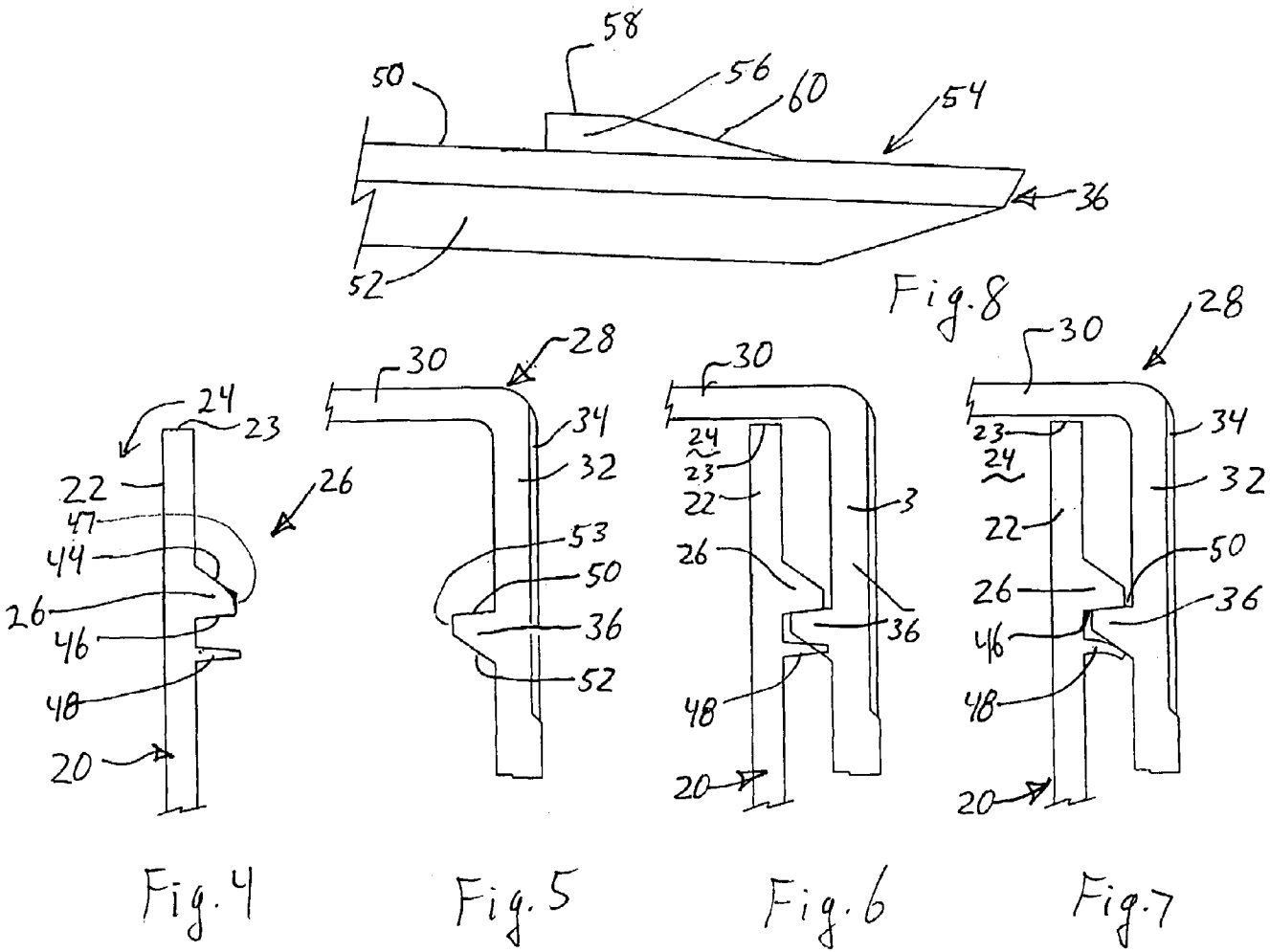
FIG. 4 is a partial cross section of the neck of the container of FIG. 2.
FIG. 5 is a partial cross section of the cap of FIG. 1.
FIG. 6 is a partial cross section showing the theoretical overlapping positions the container threads and locking tabs of FIG. 4 and the cap threads of FIG. 5.
FIG. 7 is a partial cross section showing the engagement of the container threads and locking tab of FIG. 4 and the cap threads of FIG. 5.
FIG. 8 is a partial plan view of a distal end of a cap thread showing the locking member of FIG. 1 in more detail.

Referring to FIGS. 2-4, a container 20 has a neck 22 defining an opening 24 to the inside of the container. The neck 22 and opening 24 are typically cylindrical and centered about longitudinal axis 25 of the container 20. The neck 22 may be an identifiable portion of different thickness than the body of the container 20 as shown in FIGS. 2-3, or it may be of the same thickness as the body and simply reflect the portion of the container adjacent the opening 24 that is threaded or bears the locking components as in later embodiments of the container 20. One or more container threads 26 are formed on the neck 22 and typically extend along a helix concentric with the longitudinal axis 25. The threads 26 can be internal or external, but are preferably external threads. The depicted container 20 has a flange 27 around its exterior circumference against which the lower edge of the cap 28 abuts, but the flange is optional.

Figure 1:
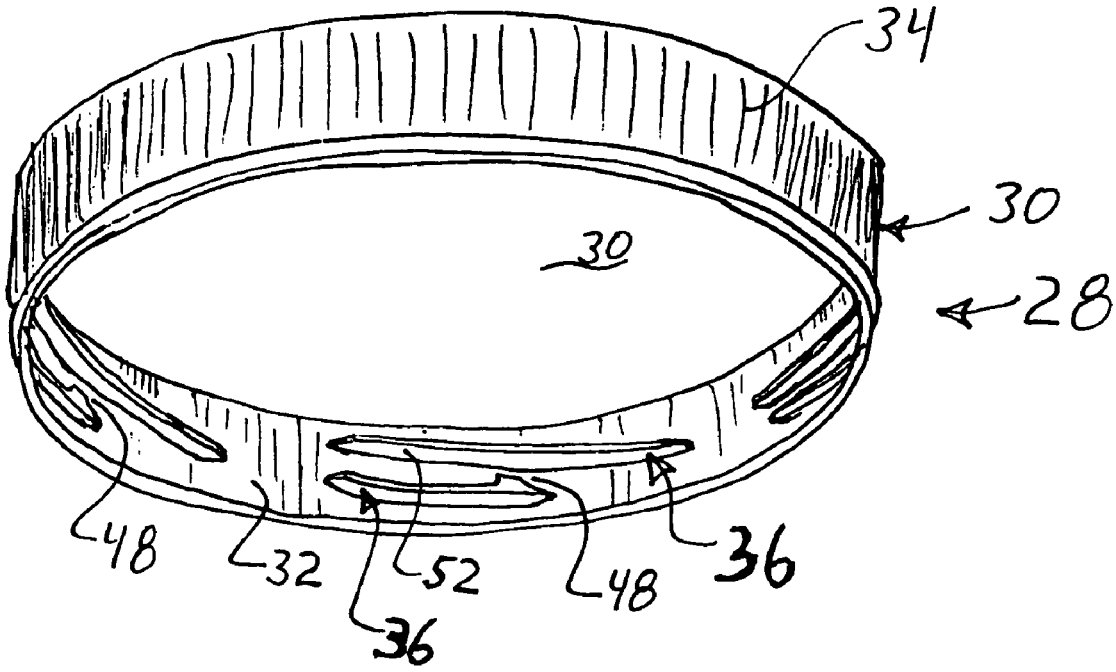
FIG. 1 is a perspective view of an inside of a cap having threads with a locking member on the distal end of the thread.

Referring additionally to FIGS. 1 and 5, a cap 28 is sized to cover the neck 22 and opening 24. The cap 28 has a top 30 which is typically disk shaped, with a flange or skirt 32 depending from the periphery of the top. A knurled or textured surface 34 is preferably, but optionally formed on an exterior portion of the skirt 32 to make it easier to grip the cap 28. Cap threads 36 are formed on the skirt 32 and sized and located to mate with the container threads 26. The cap threads 36 can be external or internal, and are shown as internal threads 36 to mate with the external container threads 26. Thus, the cap 28 is screwed onto the neck 22 of the container 20 to close the opening 24 to the container. In some embodiments the skirt could represent the exterior side of a solid plug, and the use of "skirt" herein encompasses that embodiment.

As best seen in FIGS. 2-3, the distal end of each container thread 26 does not end in a normal manner by angling toward and blending into the neck 22 of the container 20. Instead the distal end advantageously takes the form of shaped distal end 38 having a sharp face that is preferably perpendicular to the neck 22 and perpendicular to a longitudinal axis 42 along the thread that runs along the crest 47 of the container thread 26. The container thread 26 has an upper side 44 and a lower side 46 separated by crest 47. Below the shaped end 38 is a locking tab 48 separated from the lower side 46 of the container thread 26 a distance d that varies. The locking tab 48 preferably, but optionally, extends outward from the neck 22, preferably radially outward. While the container thread 26 is inclined to the longitudinal axis 25, the locking tab 48 is preferably in a plane orthogonal to the longitudinal axis. As shown in FIGS. 2 and 3, the container thread 26 extends downward from right to left, while the locking tab 48 is horizontal, so the space d between the container thread 26 and the locking tab 48 narrows toward the distal end of the thread 26. The distance d is advantageously about the same as the width of the cap thread 26 measured at the root of the thread, and is preferably sufficiently smaller that it causes the resilient locking tab 48 to provide a resilient force urging the mating thread into a desired position as described herein. The trailing end of the locking tab 48 is advantageously flat and formed along a line extending radially from axis 25. The leading end of locking tab 48 is advantageously curved or inclined to make it easier to engage the mating thread(s) and engaging member or hook.

As used herein, the leading end is the end that leads or first makes threading engagement with the mating part when the threads are being tightened, and the trailing end is the opposing end. As used herein, the terms top or upper or above will refer to the direction from the bottom of the container toward the opening 24 and cap 28 which are opposite the bottom when the cap is on the container. The terms down or lower or below will refer to the opposite direction which is from the cap 28 and opening 24 toward the bottom of the container and away from the cap. The term outward or outer refers to a direction away from the longitudinal axis 25 of the container 20, and inward or inner refers to a direction toward that longitudinal axis.

Referring to FIGS. 1, 5 and 8, the cap thread 36 has an upper side 50 and a lower side 52 separated by a crest 53, and a distal end 54 that tapers from the crest of the cap thread to the inner wall of the skirt 32. A locking member 56 extends upward from the upper side 50 of the distal end of 54 of the cap thread 28. The locking member 56 has a barb 58 adjacent an inclined surface 60 so the barb 58 can engage the shaped end 38 to prevent movement in one rotational direction about axis 25, with an inclined surface 60 facilitating movement in the other rotational direction about axis 25. The width at the root of the cap thread 36 on which the locking member 56 is located, is preferably slightly larger than the distance d between the locking tab 48 and the distal end of the container thread 26, causing the locking tab 48 to exert a resilient force on the abutting thread 36. The width of the locking member 56 further increases this width, but advantageously does not increase it sufficiently to fracture or permanently deform the locking tab 48.

Figure 11:
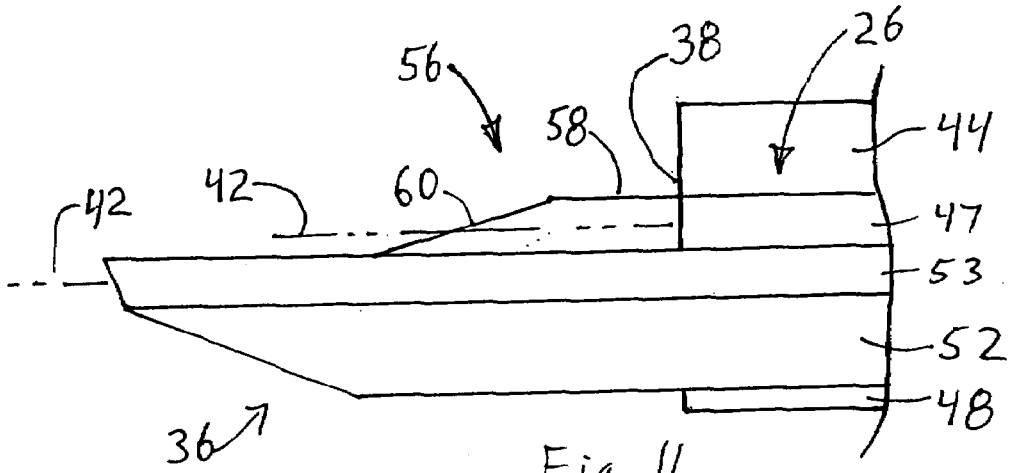
FIG. 11 is a partial plan view of a distal end of a cap thread showing the locking member of FIG. 1 engaged with a thread at a 90° angle.
Figure 9:
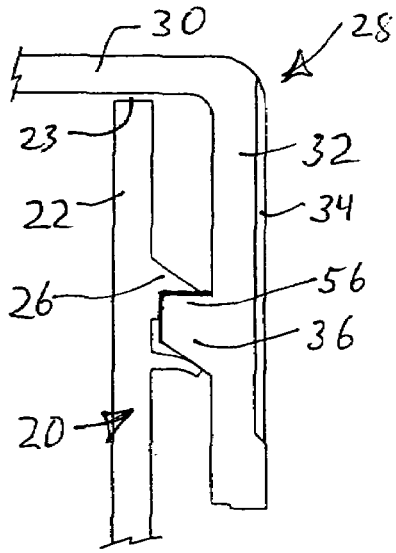
FIG. 9 is a partial cross section showing the aligned overlap of the container threads and locking tab of FIG. 4 and the cap threads of FIG. 5.

Referring to FIGS. 1-10, as the cap tightens, the locking member 56 on the cap thread 36 advances with the relative rotation of the cap 28 and container 20 about axis 25 and the inclined surface 60 advances the barb 58 past the shaped end 38 of the container thread 26, with the locking member 56 and barb 58 resiliently urged upward by the locking tab 48 so the barb 58 is located above the lower side 46 of the container threads 26. When the cap 28 is rotated the other way about axis 25, as when the cap is removed, the locking tab 48 holds the locking member 56 up so the barb 58 on the locking member abuts the shaped end 38 of the container thread 26. The locking tab 48 thus resiliently urges the barb 58 into overlapping rotational alignment with the shaped end 38 in order to restrain rotation in one direction about axis 25. The overlapping alignment is seen in FIGS. 1, 9 and 11. By pushing the cap 28 downward the distal end 54 of the cap thread 36 is forced against and bends the resilient locking tab 48, allowing the barb 58 of locking member 56 to move out of rotational alignment with shaped end 38, and to pass below the shaped end 38 of the container thread 26 so the cap can be unscrewed and removed.

During use the distal end 54 of the cap thread 28 passes between the narrowing space d (FIG. 2) separating the locking tab 48 and the container thread 26. The distal end 54 of the cap thread 36 hits the locking tab 48 and is resiliently urged upward toward the container thread 26 by the locking tab 48. Pushing on the cap 28 causes the distal end 54 of cap thread 36 to push against and bend the locking tab 48 in order to release the locking barb 58 of locking member 56.

Referring to FIGS. 4-7 and 9, the details of the parts are described. The container thread 26 advantageously has an upper side 44 that is more inclined than the lower side 46 of the thread 26. Advantageously the upper face 44 is inclined about 35° from the horizontal or 55° from the vertical. The lower face 46 is advantageously inclined about 10° from the horizontal or 80° from the vertical. A crest 47 with a width of about 0.03 inches and a crest height of about twice the crest width (about 0.065 inches) is believed suitable. Other thread dimensions could be used, and various numbers of threads could be used.

The cap threads 36 have an upper face 50 angled about 5° to the horizontal or about 85° to the vertical. The lower face 52 of the cap thread 36 is inclined at about 35° to the horizontal or about 55° to the vertical. The thread height of cap threads 36 is advantageously the same as the container threads 26, about 0.065 inches, and the thickness of crest 53 of cap thread 36 is advantageously abut the same as that of the container threads 26, about 0.03 inches. Other thread dimensions could be used, and various numbers of threads could be used, but they need to mate with and threadingly engage the container threads 26.

Details of the distal end 54 of cap thread 26 are shown FIGS. 8 and 11. The locking member 56 advantageously extends above the top side 50 of the thread 36 a distance sufficient to engage the shaped end 38. A height of about 0.03 inches is believed sufficient. To provide additional strength and to provide an engaging surface a barb 58 is provided on the locking member 56, with the length of the barb 58, preferably, but optionally, being about twice as long as the height of the locking member 56. Toward the leading end of the barb 58 an inclined surface 60 inclines toward the top side 50 of the cap thread 36. The trailing end of barb 58 forms an abutting or engaging surface configured to lockingly engage the shaped end 38. Because the barb 58 is a portion of the locking member 56, and because the barb 58 can take various shapes, a reference to aligning the locking member 56 with the shaped end 38 will be considered as encompassing the alignment of the barb 58 with that shaped end.

As seen best in FIGS. 3, 6-7, 9 and 11, when the cap 28 is threaded onto the neck 22 of container 20, the less inclined and more radial sides 46, 50 of the container and cap threads 26, 36 engage. The more inclined, lower side 52 of the cap thread 36 pushes against the locking tab 48. After the barb 58 of locking member 56 passes the end 38 of the container thread 26, the sides 46, 50 preferably remain engaged, being resiliently urged together by resilient locking tab 48.

Rotation of the cap 28 relative to the container 20 is preferably stopped when the mating surfaces of threads 26, 36 bind and stop the relative rotation, or when the lip 23 on the container 20 abuts the top 30 of the cap 28, or both. As seen in FIGS. 6-7 and 9, there is a slight gap between the top 30 of cap 28 and the adjacent lip 23 on the neck 22 of the container 20 when the locking member 56 engages the shaped end 38 of the container thread 26. This gap allows the cap 28 and container 20 to move relative to each other along axis 25 a distance sufficient to disengage the locking tab 48 from the shaped end 38 and place the locking tab 48 in the space between the locking tab 48 and container thread 26. This gap occurs before the cap 28 is completely tightened onto the container, and the parts are located to achieve this. Thus, the locking member 56 advantageously passes the shaped end 38 before the top 30 of cap 28 abuts the lip 23 on neck 22.

If the cap 24 is rotated until the top 30 abuts the lip 23 on neck 32 of the container 24, the locking member 56 can be in a rotational position well past the end of the container thread 26. Unscrewing the cap 28 still causes the barb 58 on locking member 56 to engage the shaped end 38 on the container thread 26 because the resilient tab 48 urges the locking member 56 into engagement with the shaped end 38 on the end of the container thread 26. At the position where the barb 58 on the locking member 56 engages the shaped end 38 on the container thread 26, there must be sufficient movement between the cap 28 and container 20 to allow the barb 58 to move downward along axis 25 and past the end 38 of the container thread 26.

If desired, a resilient layer (not shown) can be formed on the inside surface of top 30 and interposed between the lip 23 defining the container opening 24 and the cap 28. This resilient layer can cover the entire inside surface of top 30, or it can be an annular ring just abutting the lip 23 surrounding the opening 24. This resilient layer can be compressed to help seal the lip 23 of the container 20 opening 24 against the cap 28. Moreover, the resilient layer can also allow additional movement of the cap 28 toward the container 20 to help disengage the locking member 56.

The distance d (FIG. 2) between the locking tab 48 and the adjacent cap thread 36 preferably has a maximum dimension that is about the same as or slightly smaller than the width of the cap thread 36 measured at the root of the thread in order to make it easy to fit the cap thread 36 through the space between the locking tab 48 and the adjacent container thread 26 and provide a resilient upward force against the mating thread located in the space where that distance d is measured. A minimum dimension must be sufficient to allow passage of the barb or locking tab 48 between the locking tab 48 and the adjacent container thread 26 without causing the locking tab to break or fatigue to an unacceptable extent. Varying one or more of the dimensions of the locking tab 48 (thickness, height, length) affects the force exerted on the cap 28 to unlock the aligned engaging parts 58, 38 which block unscrewing of the cap 28. The number of locking tabs 48 also affects the unlocking force needed to disengage these parts 58, 38.

The thread 26 and locking tab 48 on the container cooperate with the skirt 32 of the cap 28 to define a narrow opening that is smaller than the corresponding dimension of the barb 58 on barbed locking member 56. The inclined surface 60 on the barbed locking member 56 helps the larger barb 58 pass through the opening, with the barb 58 engaging the shaped end 38 of the container thread 26 to prevent the barb from passing back through that opening. Pushing the cap 28 down against the locking tab 48 changes the dimensions of the opening and make the opening large enough for the barb 58 to pass through the opening and below the shaped end 38 of container thread 26. Thus, the locking tab 48 has two positions which include a locking position that holds the barb 58 in line with or in a position to engage shaped end 38 of container thread 26, and a release position in which the locking tab 48 allows the barb 58 to pass below the shaped end 38 and between the locking tab 48 and the shaped end 38 of container thread 26.

Figure 10:
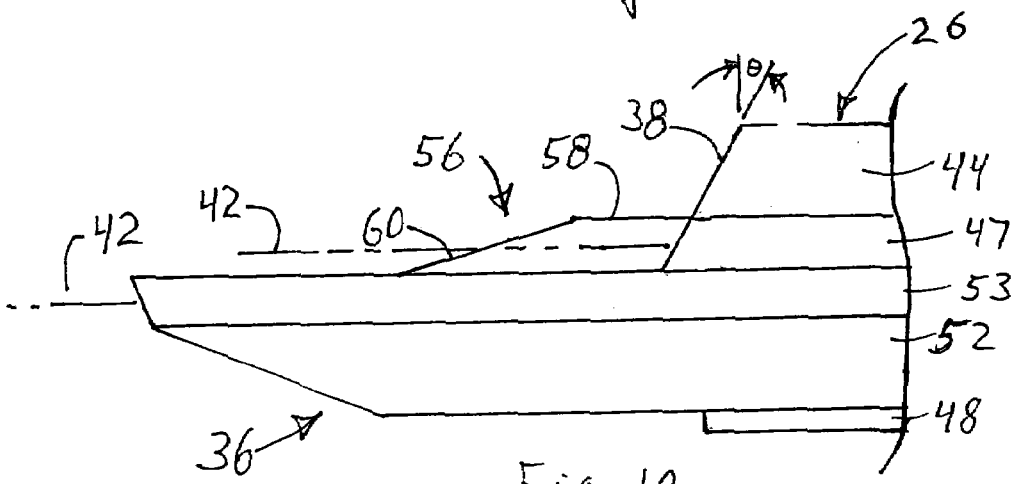
FIG. 10 is a partial plan view of a distal end of a cap thread showing the locking member of FIG. 1 engaged with a thread at an angle of $\theta$.

Referring to FIGS. 2-3 and 10-11, the shaped end 38 of the container thread 26 is preferably formed along a radial plane orthogonal to the longitudinal thread axis 42 of the thread 26. That places the abutting surfaces of the barb 58 on locking member 56 and the shaped end 38 on thread 26 on surfaces generally perpendicular to the thread axis 42. With repeated use the abutting surfaces of the barb 58 and shaped end 38 may wear and the corners become round so the locking engagement degrades. Depending on the life of the locking mechanism, it may be desirable to incline the abutting surfaces on the barb 58 and shaped end 38 to form inclined surfaces of engagement where the incline angle is selected to cause the locking member 56 and barb 58 to further engage the thread 26. Movement of locking member 56 away from locking tab 48 furthers this engagement, as would movement toward axis 25 and into the wall of the container 20. FIG. 10 shows the abutting surfaces of barb 58 and distal end 40 abutting at an inclined angle θ. Inclined angles of up to about 30° are believed suitable for use. Larger angles may work, but the sharp edges become difficult to mold and may deform and degrade unacceptably during use.

The angle θ in FIG. 10 is inclined relative to the container axis 25. Indeed, simply forming the shaped end 38 parallel with a plane through the axis 25 would produce inclined mating surfaces which lock as the cap 28 is unscrewed, because the threads 26 are inclined downward relative to the container axis 25. The angle of inclination could also be along a plane tangent to a circle concentric with axis 25 and within container 20, which would urge locking member 56 into the wall forming the container 20. Combinations of these two inclined angles could also be used.

Angles of inclination that cause the barb 58 to slide away from the shaped end 38 and thread 26 toward tab 48 are undesirable. For the barb 58 to slide over the shaped end 38 and thread 26, the barb must fit between the crest of the thread and the skirt 32 of the cap 28. The cap 28 is sufficiently stiff that this is not permitted. This type of movement essentially strips the threads and the cap 28 is sufficiently strong to prevent this. Angles of inclination that cause the locking member 56 to move toward tab 48 will unlock the parts and may break or unacceptably deform the locking tab 48.

The length and strength of the locking tab 48 can be varied in order to adjust the amount of resilient force holding locking member 56 and barb 58 aligned with the distal end 38, and that determines the force applied to the cap 28 to release the locking member 56. The strength can be varied by varying the material of locking tab 48 or by varying the dimensions of the locking tab 48. The relative overlap between the locking member 56 and the shaped end 38 (e.g., FIG. 9) of the container thread 26 can also be used to vary the force used to unlock the cap 28 from the container 20 as it affects the distance the locking tab 48 must move to disengage the locking part 38, 58.

While the above description is given with the locking tab 48 and shaped end 38 located on the container 20, they could be placed on the cap 28, in which case the locking member 56 would be on the threads 26 of the container 20. Further, the locking tab 48 could be on the same part as the locking member 56. Moreover, the locking tab 48 could be on the opposing end of the thread in some cases.

Figure 12:
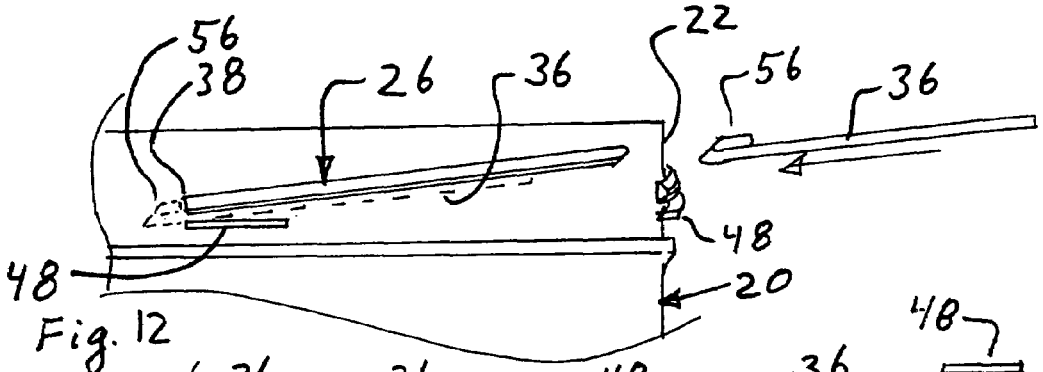
FIG. 12 is a partial plan view of the container of FIG. 3 and mating cap threads shown without the cap before engagement, and shown in broken lines after engagement.

Referring to FIGS. 12-15 several of these variations are shown. FIG. 12 shows the above described embodiment with the locking tab 48 and shaped end 38 on the trailing end of the container thread 26, while the locking member 56 is on the leading end of the cap thread 36. The locking tab 48 is located below the trailing end of the container thread 26 to form a space through which the locking member 56 on the cap is advanced, with the locking tab 48 resiliently urging the locking member 56 upward into alignment with the shaped end 38.

Figure 13:
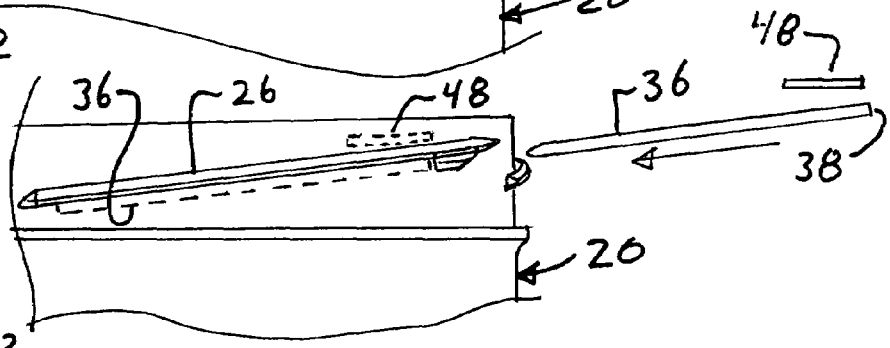
FIG. 13 is a partial plan view of a further embodiment showing a locking member on a leading end of the container and a resilient tab on a trailing end of a cap thread.

FIG. 13 shows the locking tab 48 and shaped end 38 on the trailing end of the cap thread 36, while the locking member 56 is on the leading end of the container thread 26. The locking tab 48 is located above the trailing end of the cap thread 36 to form a space through which the locking member 56 on the container is advanced, with the locking tab 48 resiliently urging the locking member 56 downward into alignment with the shaped end 38. In the embodiments of FIGS. 12 and 13, the locking tab 48 is relatively short in length and engages the locking member 56 and opposing thread only for a short length of travel.

Figure 14:
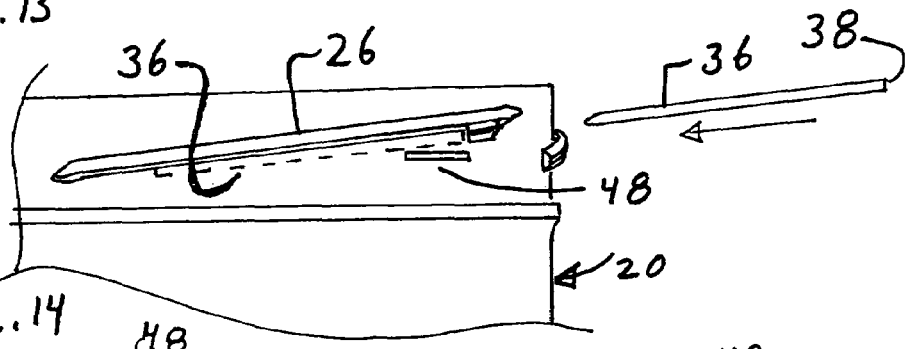
FIG. 14 is a partial plan view of a further embodiment showing a locking mechanism on a leading end of a container thread and a resilient tab below the locking tab.

FIG. 14 shows the locking tab 48 on the same part as the locking member 56, which in this case is the container 20. The locking member 56 is on the leading end of the container thread 26, while the locking tab 48 is below the locking member 56 to form a space through which the leading end of the cap thread 36 on the cap is advanced, with the locking tab 48 resiliently urging the entire length of the cap thread 36 upward against the locking member 56 as the cap thread 36 passes the locking tab 48. When the shaped end 38 passes the locking tab 56 the shaped end 38 is urged into axial alignment with the locking tab 56. In the embodiment of FIG. 14, the locking tab 48 is relatively short in length and engages the opposing thread 36 for an extended length of travel. That extended engagement increases the bending and fatigue of the locking tab 48, and is not preferred.

Figure 15:
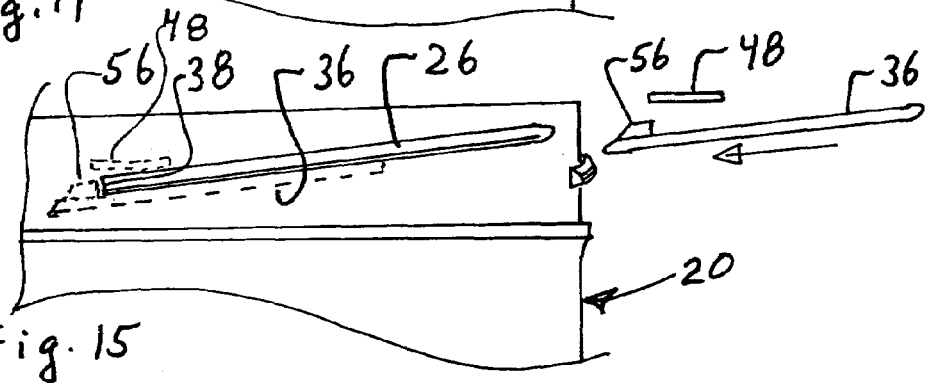
FIG. 15 is a partial plan view of a further embodiment showing a locking mechanism on a leading end of a cap thread and a resilient tab located above the locking member.

FIG. 15 shows the locking tab 48 on the same part as the locking member 56, which in this case is the cap 28. The locking member 56 is on the leading end of the cap thread 36, while the locking tab 48 is above the locking member 56 to form a space through which the leading end of the container thread 26 on the container 20 is advanced, with the locking tab 48 resiliently urging the entire length of the container thread 26 downward against the locking member 56 as the container thread 26 passes the locking member 56. When the shaped end 38 passes the locking tab 56 the shaped end 38 is urged into axial alignment (along the length of the thread axis) with the locking tab 56. In the embodiment of FIG. 15, the locking tab 48 is relatively short in length and engages the opposing thread 26 for an extended length of travel. That extended engagement increases the bending and fatigue of the locking tab 48, and is not preferred.

In the embodiments of FIGS. 12-15 the locking tab 48 is shown at a distal end of the threads, but it could be elsewhere along the length of the thread. Similarly, the locking member is shown as a distal end of the thread, but it could be elsewhere along the length of the thread.

The location of the locking tab 48 varies depending on which part as the tab is located. Referring to FIGS. 12-15, if the locking tab 48 is located on the container 20 as shown in FIGS. 12 and 14, then the locking tab 48 engages or pushes upward against the cap thread 36 to urge the cap 28 upwards. That also allows a downward force on the cap 28 to bend the locking tab 48 downward to release the locking member 56. If the locking tab 48 is located on the cap 28 as shown in FIGS. 13 and 15 then the locking tab 48 engages or pushes downward against the container thread 26 to urge the cap 28 upwards. That also allows a downward force on the cap to bend the tab 48 upwards to release the locking member 56.

As seen from the various embodiments of FIGS. 12-15, the locking member 56 is always on the leading end of the thread. But the orientation of the locking member 56 varies. When the locking member 56 is on the cap 28 as in FIGS. 12 and 15, then the locking member extends upward and is resiliently urged upward against the abutting thread of the container 20. When the locking member 56 is on the container 20 as in FIGS. 13 and 14, then the locking member 56 extends downward toward the abutting cap threads 36. The above observations apply if there is a single thread, but do not necessarily apply if there are multiple threads along the vertical container axis 25.

Figure 16:
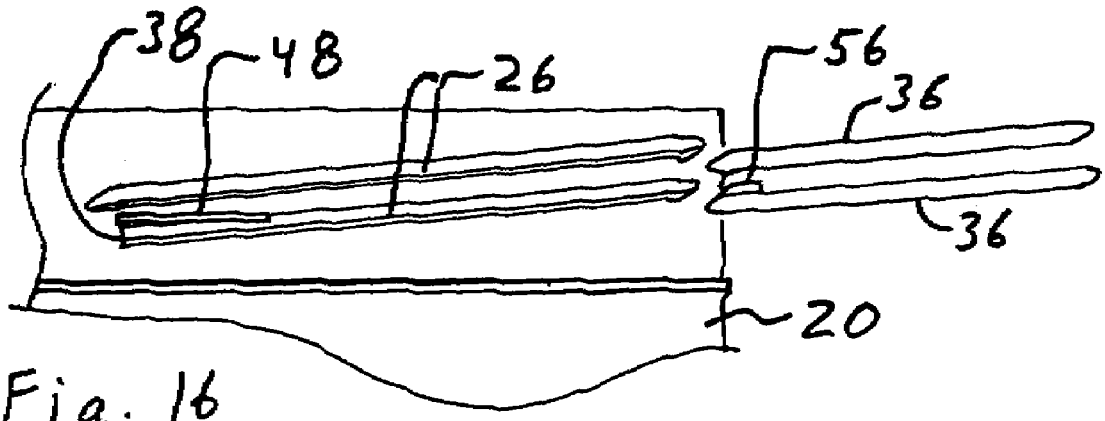
FIG. 16 is a partial plan view of a further embodiment showing multiple threads with a resilient tab located between adjacent threads, and a locking member on a leading end of a cap thread.

Referring to FIG. 16, a further variation of the embodiment of FIGS. 3 and 12 is shown in which there are multiple threads 26, 36, with the locking tab 48 located between two adjacent container threads 26. The locking tab 48 extends from the same thread 26 as the shaped end 38, and is preferably, but optionally aligned to end about the same location as the shaped end 38, but above that shaped end 38 a distance sufficient so the tab 48 does not prevent the locking member 56 from aligning with and lockingly engaging the shaped end 38. Of the two cap threads 36 shown in FIG. 16, the top thread abuts and is urged upward by the locking tab 48 which in turn urges the cap 28 and the lower thread 36 and the locking member 56 upward so the locking member 56 is urged into alignment with the shaped end 38 along the length of the thread axis.

Figure 17:
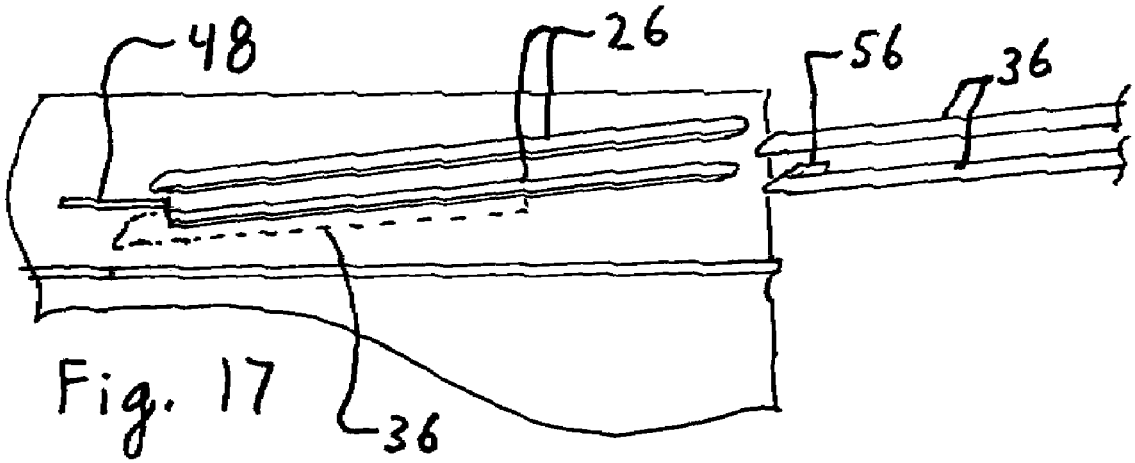
FIG. 17 is a partial plan view of a further embodiment of FIG. 16.
Figure 21:
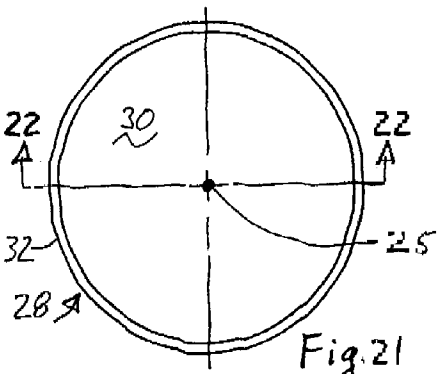
FIG. 21 is a top plan view of the cap of FIG. 18.
Figure 22:
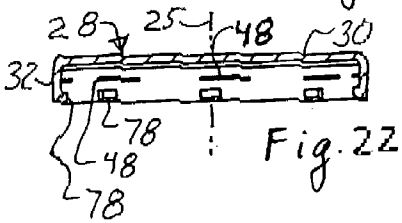
FIG. 22 is a sectional view taken along 22-22 of FIG. 21 showing the locking tabs.

The top cap thread 36 extends between the two adjacent container threads 26 and abuts the resilient locking tag 48. The locking tab 48 is sized so it does not wedge and jam the cap thread 36 between the adjacent container threads 36. The locking tab 48 is also sized so it can deform when the cap thread 36 hits it and not break off. Advantageously the resilient locking tab 48 is located between, and toward an end of the thread(s) between which it is located. Advantageously the locking tab extends from and beyond a distal end of a thread, but if so it is located so it does not prevent the locking member 56 from aligning with and lockingly engaging the shaped end 38. Because the radially outward edge of the locking tab 48 engages the crest of the mating cap thread 36, the locking tab can deform without wedging or freezing the mating threads 26, 36, and it can resiliently urge the cap upwards while allowing the locking member 56 to engage the shaped end 38. This variation is shown in FIG. 17, and has the advantage of reducing the deformation and fatigue of the resilient locking tab 48.

The use of adjacent parallel threads with the locking tab 48 located between those adjacent threads could be applied to the other embodiments disclosed herein, specifically including the embodiments of FIGS. 13-15, and specifically including placing the tab 48 between adjacent cap threads 38, and specifically including placing the tab 48 at either the leading or trailing end, or at locations intermediate the leading and trailing ends. Further, the use of parallel adjacent threads 26, 36 also allows the use of a gap along the length of a lower one of two adjacent threads with the gap being formed by a shaped end 38 and the gap of sufficient length to accommodate the locking member 56 to align and engage that shaped end.

As described above the container threads 26 are on the external side of the opening 22. But the container threads 26 could be on the internal side of the opening 22, in which case the mating cap threads 36 would be on the outside of the skirt 32.

Various polymers could be used to make the container and cap, including various thermoplastics, polypropylene, polyethylene, polyacrylate, or other polymers. The container and cap could be made of metal with the threads 26, 36 and locking tab 48 being cut or molded or cast. Glass can be used only if the locking tab 48 is made of a flexible material held in position on the appropriate glass part. Various other materials could be used given the disclosure herein. Preferably the threads 26, 36, distal end 38, locking tab 48 and locking member 56 are integrally molded or cast along with the parts to which they are affixed, as by molding or casting that uses a flowable material to produce a part having a single, uniform material and unitary construction. Die casting of polymers is believed suitable.

The threads 26 can be single or multiple lead, and are shown as four lead threads, with each thread extending about ¼ turn around the periphery of the neck 22. But various thread lengths could be used, and the number of threads can vary, as can the angle of inclination of the threads.

The threads 26, 36 are shown as continuous threads, but they could be segmented threads, in which a particular thread could be interrupted by gaps, or formed of a series of segments on the same thread axis 42. If such interrupted threads are used then the length of the inclined surface 60 and barb 58 should be larger than any space between adjacent segments in order to prevent the barb 58 from slip 23 ping into the gap between adjacent segments.

The inclined surface 60 advantageously leads the barb 58 through the opening between the locking tab 48 and the adjacent container thread 26. But the inclined surface 60 is optional. It is preferable because it provides for a gradually increasing torque to lock the cap 28 onto the container 20. Similarly, the barb 58 is advantageously located at the distal end of the cap thread 36. But the barb 58 could be located at various locations along the length of the thread 36, as long as a shaped end 38 is located to abut the barb 58, and as long as resilient tab 58 is located to resiliently urge the barb 58 into engaging alignment with the shaped end 38. Preferably barb 58 is set back enough along the length of the thread 26 that when the cap 28 is tight on the container 20, the barb is past the shaped end 38.

The amount of overlapping rotational alignment between barb 58 and shaped end 38 will vary with the materials used, the sizes of the threads 26, 36, and with the shape of the distal end 38 and the shape of the mating barb 58. The amount of overlap should be sufficient to restrain rotation in one direction about axis 25 so that a child cannot rotate the lid 28 relative to the container 20 and remove the lid.

The locking tab 48 used with the above container thread 26, has opposing sides inclined toward each other at an angle of about 5° to the horizontal, with the trailing end square and the leading end inclined. That slight angle on the sides makes it easy to mold the tab 48. The tab 48 has a length of about 0.072 inches, which makes the locking tab 48 extend radially slightly beyond the crest height of the container thread 26. A crest thickness of about 0.01 inches is believed suitable for the locking tab 48, when made of polypropylene. Other dimensions could be used.

The length of the locking tab 48 is preferably short relative to the length of the adjacent container thread 26. A longer locking tab 48 increases the force needed to unlock the aligned parts 58, 38 if the entire length of the tab 48 is engaged against the cap thread 36, and if not engaged then unnecessary material is used and costs are unnecessarily incurred. In the illustrated embodiment the container thread extends about ¼ turn around the circumference of the neck 32, or extends for an arc of about 90°. The circumferential length of the locking tab 48 will vary with the pitch of the threads 26, 36, with shorted lengths more likely used with larger pitch threads, and longer lengths more likely used with smaller pitch threads. Advantageously, the locking tab 48 extends for an arc of about 10° to about 30°, or about ⅛ to ⅓ the length of the adjacent cap thead 26. Further, if the locking tab becomes too short in length and sufficiently thin it may be possible that it can cut a person, so advantageously the tab 48 extends for at least about 2-5°. The locking tab 48 could be formed of a series of segments, and need not be continuous.

The locking tab 48 is shown as orthogonal to the container axis 25 while the thread 26 is inclined relative to that axis. The tab 48 could be similarly inclined relative to the axis 25 and adjacent container thread 26 so the length of the tab 48 is parallel to the axis 42 of thread 26, or inclined at a different angle toward the shaped end 38, or even inclined away from the shaped end 38.

As shown in FIGS. 1-3, the trailing end of the locking tab 48 ends in substantial alignment with the shaped end 38. This substantial alignment includes ending a little in front of, or a little behind the distal end 38 as measured along the length of the thread 26, with the substantial alignment preferably including the leading end of locking tab 48 and distal end 38 being within an arc of about 5° or less relative to axis 25, and more preferably with the trailing end of the locking tab 48 extending beyond the shaped end 38. This alignment applies to the other locations of the locking tab 48 shown and described herein.

The container 20 and cap 28 can be used with tamper evident features known to those skilled in the art. Such tamper evident features include a band or other member extending between and fastened to each of the cap 28 and container 20 so that relative movement of the cap and container would fracture the band or member to indicate tempering or removal of the cap. Thus, a frangible band, or a removable band could be used as one example to indicate tampering. Alternatively, the locking tab 48 can be constructed to fracture and indicate tampering, or it can be cut to indicate tampering. The frangible locking tab 48 can be achieved by appropriately designing the locking tab 48 so it breaks or shows permanent deformation when the cap 28 is removed with the deformation visible before the cap is removed. The cut tab can be achieved by placing a barb on the lower side of the locking member 56 which barb is very short but which has a cutting edge that engages and cuts the locking tab 48. A hooked curved or hooked cutting edge would shield the cutting edge from accidental contact by a person's finger while providing a sufficiently sharp edge to cut the tab 48. The tab 48 could have a portion depending therefrom a distance that extends beyond the skirt 32 so as to be easily visible from the exterior of the container 20 and thus indicate whether the tab 48 was cut and the container opened.

The locking tab 48 is shown as a thin, radially extending flange or plate. But the locking tab can have various shapes, including a cylindrical post with a flat end or a rounded end, or any other shape. But the shape and material of the locking tab 48 should provide sufficient flexibility that it will not jam or wedge tight the abutting threads when it is placed between two adjacent threads 36 of the cap 28 or two adjacent threads 26 of the container 20. The shape and material of the locking tab 48 should provide sufficient resilient force to urge the locking member 56 so the hook 58 aligns with shaped end 38. Further, the shape of the locking tab 48 is preferably, but optionally such that it can be readily molded to form a unitary, simultaneously molded part of the cap or container from which it extends.

The locking member 56 and especially its barb 58 and shaped end 38 thus provide a locking means for preventing rotation of the cap 28 in one direction when the barb 58 and shaped end 38 are aligned to abut each other, so as to prevent removal of the cap 28. The locking tab 48 provides resilient means for aligning the barb 58 and shaped end 38 so they abut and prevent further rotation along one rotational direction. The flexible, resilient locking tab 48 located underneath the container thread 26 pushes upward on the cap threads 36 to align the barb 58 and shaped end 38 and lock the threads against rotation in one direction. That alignment is maintained until the locking tab 48 is bent downward by force on the cap threads 36 exerted by relative movement of the container 20 and cap 28.

Referring to FIG. 3, while the locking members can be formed on cap threads 36 or container threads 26, it is possible for the parts to lockingly engage if the locking members 56 are located only less than all of the cap threads 36, on less than all of the container threads 26. As long as one locking member 56 engages one distal end 38, the parts can lockingly engage. On the other hand, if the shaped ends 38 are not formed on every thread on either the cap or container, then it is possible for the locking member 56 to be pushed in rotational alignment with a normal thread 26, 38 in which the distal end angles toward the adjacent surface of the cap or container. In that case barb 58 could wedge against the inclined end of the abutting thread and jam the cap onto the container. This possible wedging can be avoided by having shaped ends 38 on all the appropriate threads. Thus, it is advantageous, but not required to have locking members 56 on all threads of either the cap or the container, and it is advantageous but not required to have the shaped ends on all threads of either the cap or container.

There is also provided a method for releasably locking a cap onto a container 20 by resiliently urging a barb 58 on one of a cap or container thread into alignment with a distal end of the other thread. The resilient locking member 48 maintains that alignment during locking. Moving the thread 36 containing the barb 58 against the locking tab 48 bends the resilient tab sufficiently to shift the alignment so the barb passes below the previously aligned thread (end 38), releasing the lock. The method also includes using a resilient locking member 48 to form a variable sized opening between the locking member and an adjacent thread 26. The opening has a smaller, locking size and a larger, unlocking size with the unlocking size allowing downward movement of the locking member 56 and/or barb 58. A thread 36 with an enlarged locking end 56 is shaped to pass through the opening in one direction whereupon the opening assumes a smaller locking size so a wall (end 38 on thread 36) partially defining the opening engage the enlarged end 56. By moving the resilient tab 48 the opening can be changed to the larger, unlocking size which is sufficient to allow removal of the enlarged end.

The locking tab 48, shaped end 38 and barb 58 can be easily molded, without the need for complex molds. That makes the potential cost of the parts lower. Further, the cap 28 and container 20 can each be a single, entirely molded part, with no need to assemble multiple parts to form the cap 28, and no need to assemble multiple parts to form the container. Each of the cap 28 and container 20 can be integrally molded of a single, flowable material. That provides for ease of manufacture, and can contribute to lower costs.

Referring to FIGS. 18-23, a still further embodiment is shown. This embodiment uses a bayonet 70 having a curved leading edge 72 with a notched or recessed portion 74 and an optional stop 76. The bayonet 70 is shown as extending radially outward from the container 20 and is located immediately below the lip 23. The notch 72 is interposed between the stop 76 and the end of the curved leading edge 72. The curved edge curves toward a bottom 80 of the container and forms a shaped end 38. The curved leading surface 72 corresponds to the leading portion of the threads 26 on the container, which terminate in the same shaped end 38. The stop 76 extends toward the bottom 80 of the container a distance greater than that of the curved surface 72. There are a plurality of bayonets 70 around the periphery of the container 20. The number can vary.

Figure 18:
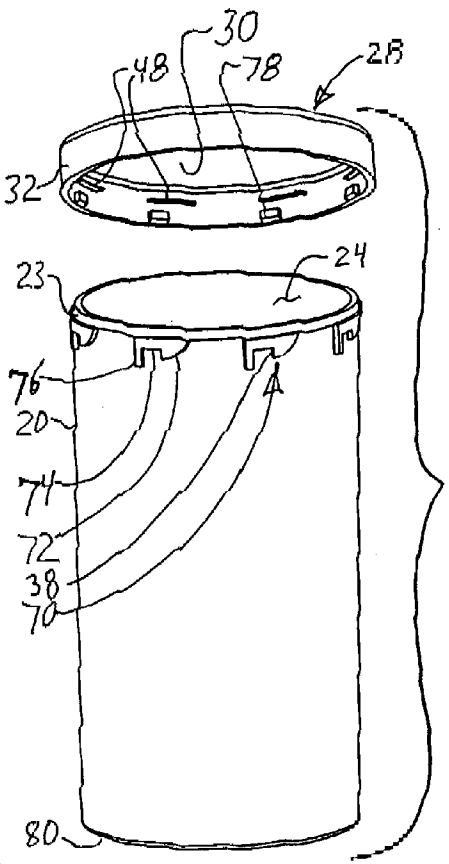
FIG. 18 is an exploded perspective view of a container and cap of a further embodiment having locking tabs and bayonets.
Figure 19:
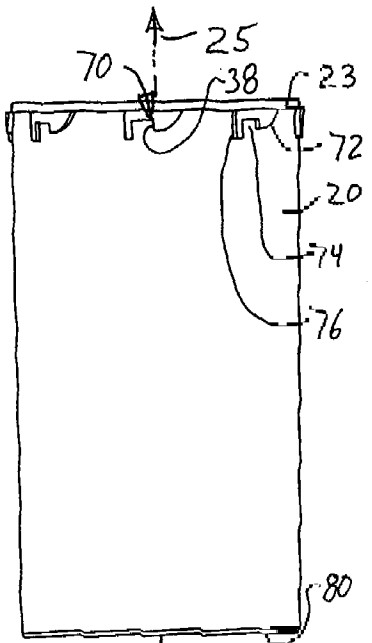
FIG. 19 is a side plan view of the container of FIG. 18 showing bayonets.
Figure 20:
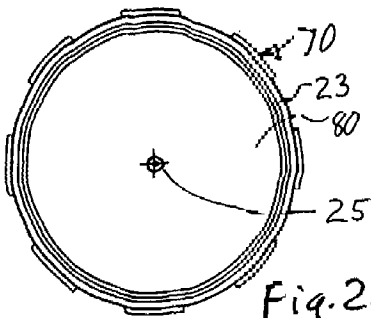
FIG. 20 is a bottom plan view of the container of FIG. 19.

The cap 28 has a plurality of resilient locking tabs 48 spaced from the top 30 of the cap 28 and extending inward, preferably radially inward toward axis 25 of the opening 24 (FIG. 18). The number of locking tabs 48 preferably corresponds to the number of bayonets 70. Below and aligned with the leading end of each locking tab 48 is a locking lug 78 which extends inward, and preferably extends radially inward toward axis 25.

Figure 23:
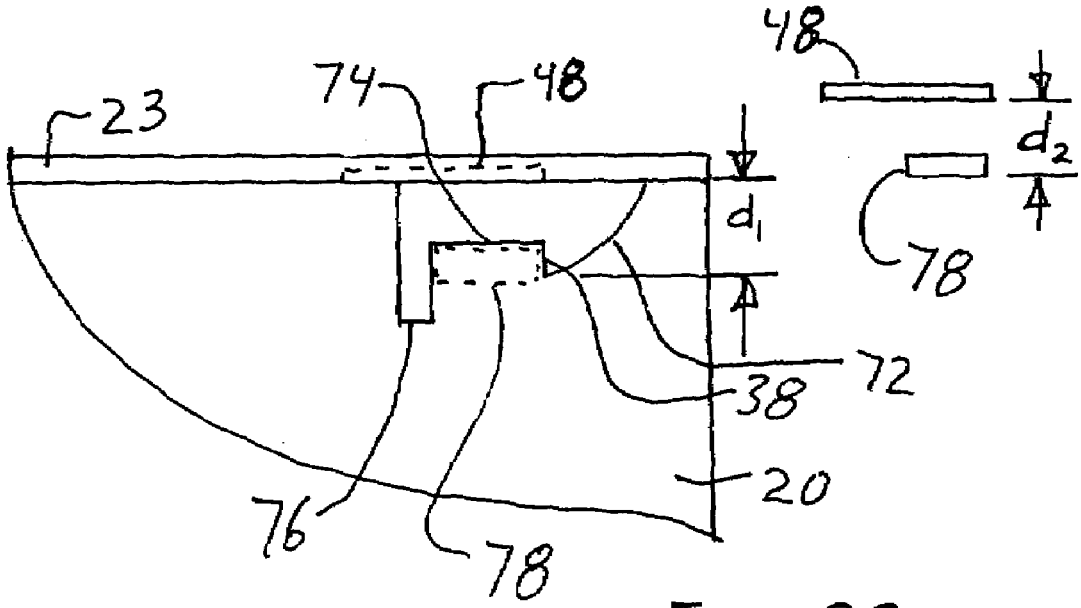
FIG. 23 is a partial plan view of the bayonets of FIGS. 18-19 engaging the locking tabs of FIGS. 18 and 22.

Referring to FIGS. 18 and 23, as the cap 28 is placed on the container 20, the locking lug 78 and resilient locking tabs 48 fit in the gaps or spaces separating the bayonets 70. Relative rotation of the cap 28 and container 20 cause the leading end of the lug 78 to advance and abut the leading end of the curved surface 72 which cams the lug 78 and cap 28 downward toward the bottom 80 of the container. At some point along the advancement of the lug 78 along the curved surface 72 the resilient locking tab 48 abuts the lip 23 and resiliently resists the movement of the cap 28 toward the container. When the tab 78 rotates past the shaped end 38 the lug 78 fits into the recess or notch 74. The resilient locking tab 48 resiliently urges the lug 78 into the recess 74. The locking tab 48 could, but need not, resiliently urge the lug 78 against the surface forcing the notch 74. When the lug 78 is in the notch 74 the shaped end 38 is rotationally aligned with the trailing end of the lug 78 so that the lug 78 hits the shaped end 38 and prevents the cap 28 from being unscrewed or taken off. Further advancement of the lock causes the lug 78 to hit the stop 76. The stop 76 thus limits the rotation of the cap 28 and prevents further relative rotation of the cap and container 20.

As shown in FIG. 23, the leading end of the locking tab 48 advantageously leads the leading end of the locking lug 78. The trailing end of the locking tab 48 is aligned with the trailing end of the lug 78. The locking tab 48 is advantageously, but optionally, has a length, measured around the circumference of the container 20, about twice as long as that of the lug 78. Different lengths and relative positions of the locking tab 48 and lug 78 could be used. Further, the greatest distance between the lip 23 and the curved surface 72 is a distance $d_1$ while the locking tab 48 is a distance $d_2$ above the lug 78. The distance $d_1$ is greater than the distance $d_2$ so the locking lug 78 is resiliently urged into the recess 74 and maintained there to lock the cap to the container.

To unlock the cap, the cap 28 and container 20 are moved along axis 25, which corresponds to pushing the cap downward toward the container, or pushing the container upward toward the cap. The resilient locking tab 48 is bent enough to allow the lug 78 to disengage from the shaped surface 38 and move toward the leading end of the curved surface 72. When the locks 78 are aligned with the spaces between bayonets 70, the cap 28 can be removed along axis 25.

The locking lug 78 corresponds to the barb 58 of the locking member 56, and unless expressly stated or unless described in a way that precludes a cross-reference, a reference to one should be considered a reference to the other. While the lug 78 is shown without an inclined barb 58, the lug 78 could be configured to have one. The inclined, and preferably curved surface 72 corresponds to the threads 26, 36 or to the inclined portion of the locking member 56. Unless expressly stated or unless described in a way that precludes a cross-reference, a reference to a "thread" should be considered a reference to the curved surface 72 or the inclined portion of the locking member 56 or to the inclined threads 26, 36, and vice versa. A reference to a "screw thread" should be understood to preclude such a cross reference and refer only to the threads 26, 36 and locking member 56, and a reference to a bayonet should be understood to preclude such a cross reference.

The locking tab 48 is the same as in the threaded configurations of FIGS. 12-15, but the locking tab 48 abuts the lip 23 rather than abutting a thread 26, 36. The shaped end 38 is the same as in the threaded configurations of FIGS. 12-15, and abuts a corresponding portion of the lug 78.

The curved surface 72 could be a straight surface inclined toward the bottom 80 of the container 20, and need not be curved—other than to curve around the surface of the container 20. Both the curved surface 72 and the threads 26, 36 form inclined, cam surfaces using relative rotation of the cap and container to urge the locking members 56, 78 into rotational alignment with the shaped end 38, with the locking tab 48 providing the resilient force which urges relative axial motion of the cap and container to place the locking members 56, 78 in rotational alignment with the shaped end 38. The locking tab 48 also provides the resilient force maintaining the locking members 56, 78 in rotational alignment with the shaped end 38 so as to prevent removing the cap from the container. The locking tab 48 also provides the resilient movement needed to disengage the alignment of the locking members 56, 78 from the shaped end 38 by bending the locking tab to misalign the locking members 56, 78 from the shaped end 38.

The locking member 78 is shown as rectangular with an end parallel to axis 25, but various shapes can be used for locking member 78, and the end of the locking member 78 that abuts shaped end 38 can be inclined as described relative to barb 58 and end 38. Further, the locking tab 48 is shown as segmented, but it could be continuous, forming a short flange extending inward toward axis 25, with the flange advantageously, but optionally having a quadrilateral cross section, and preferably having a thin rectangular cross section where the radial dimension toward axis 25 is at least two times the axial thickness measured along axis 25, and preferably 3-8 times the axis thickness.

The bayonet 70 is shown on the container 20, with the lug 78 and locking tab 48 on the cap, which is analogous to the threaded configuration of FIG. 15. But the bayonet 70 could be on the cap 28 and locking tab could be on either the cap or the container. There are thus configurations for the bayonet 70, lug 78 and resilient tab 48 analogous to FIGS. 12-15, with suitable modifications to accommodate the stop 76. For brevity, only one more of those analogous variations is described.

Figure 24:
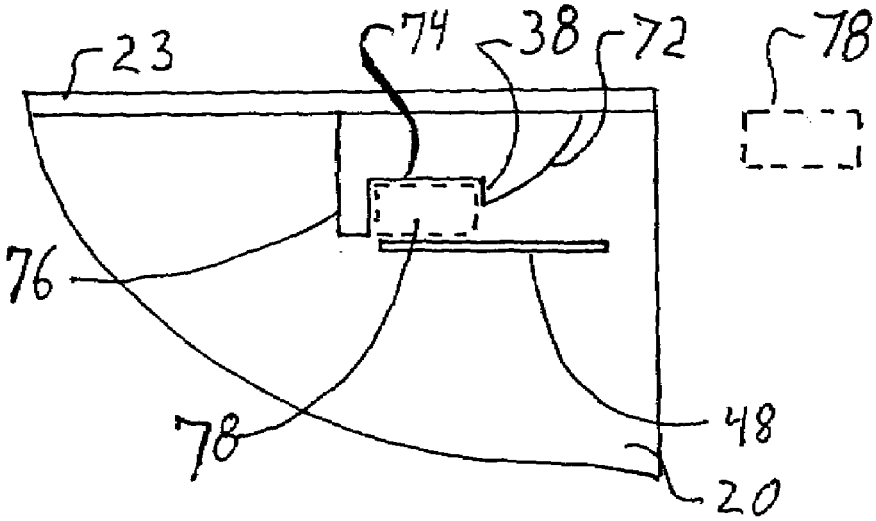
FIG. 24 is a partial plan view of the a further embodiment of bayonets and locking tabs of FIGS. 18-19.

FIG. 24 shows a configuration analogous to that of FIG. 12 in which both the resilient locking tab 48 and the inclined surface 72 are on the container, with the locking lug 78 on the cap. The locking lug 78 is shown as thicker in FIG. 24 than it was in FIG. 23, but the sizes can vary. In this embodiment the resilient tab 48 has a leading edge aligned with the end of the recess 74 and the beginning of the stop 76 so as to resiliently urge the locking lug 78 into the recess. The locking tab 48 is apaced far enough from the adjacent portion of the curved surface 72 so the lug 78 can fit between the parts to lock and unlock the lug 78 with the recess 74.

The above description is given by way of example, and not limitation. Given the above disclosure, one skilled in the art could devise variations that are within the scope and spirit of the invention. The various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A releasable locking cap and container having a common longitudinal axis where the container has an opening with at least one container thread adjacent the opening with the thread sized and located to threadingly engage at least one cap thread formed on a skirt of the cap by relative rotation about the longitudinal axis, comprising:

a shaped end on at least one of the cap or container thread and a barb on the other of the at least one cap or container thread, the barb being on a leading end of the thread;

a resilient locking tab extending from one of the cap's skirt or container, the locking tab being spaced apart from the shaped end a distance along the longitudinal axis sufficient to allowing passage of the barb beyond the shaped end but and a second position sufficiently close to resiliently urge the barb into overlapping rotational alignment with the shaped end, the shaped end being configured to lockingly engage the barb, the resilient locking tab and the shaped end overlapping along the rotational direction so that a plane containing the longitudinal axis intersects both the locking tab and the shaped end.

2. The locking cap and container of claim 1, wherein the resilient locking tab abuts the same thread, which comprises a screw thread, as the one containing the barb.

3. The locking cap and container of claim 1, wherein the threads comprise screw threads and the resilient locking tab abuts a screw thread with which the barb is lockingly engaged.

4. The locking cap and container of claim 1, wherein the threads comprise screw threads and there are a plurality of adjacent screw threads and the resilient locking tab abuts a screw thread with which the barb is not lockingly engaged.

5. The locking cap and container of claim 1, wherein the threads comprise screw threads and the resilient locking tab is located at least in part between two adjacent and vertically parallel screw threads.

6. The locking cap and container of claim 1, wherein the at least one thread is concentric with a central axis of the opening, and the locking tab extends in a plane orthogonal to that axis.

7. The locking cap and container of claim 1, wherein the locking tab and shaped end extend from the container.

8. The locking cap and container of claim 7, wherein the locking tab comprises a thin flange having a rectangular cross-section and extending outward from the container.

9. The locking cap and container of claim 7, wherein the threads comprise screw threads and the locking tab is at a trailing end of the at least one screw thread on which the locking tab is formed.

10. The locking cap and container of claim 1, wherein the barb is located on the at least one cap thread and the shaped end is located on the at least one container thread, and the resilient tab is located on the container.

11. The locking cap and container of claim 10, wherein the thread on the container comprises a bayonet having an inclined leading end and a recess formed between the shaped end and a stop, with the barb comprising a lug sized to fit in the recess and rotationally align with the shaped end barb.

12. The locking cap and container of claim 1, wherein the barb is located on the at least one cap thread on the inside of the skirt, and the shaped end is located on the at least one container thread on an exterior of the container, and the resilient tab is located on the exterior of the container.

13. The locking cap and container of claim 1, wherein the barb is located on the at least one cap thread on the outside of the skirt, and the shaped end is located on the at least one container thread on an inside surface of the container, and the resilient tab is located on an inside surface of the container.

14. The locking cap and container of claim 9, wherein the threads comprise screw threads and the barb is located on the at least one cap thread and the shaped end is located on the at least one container thread, and the resilient tab is located on the container.

15. The locking cap and container of claim 1, wherein the threads comprise screw threads and the barb is located on a leading end of the at least one cap thread and the shaped end is located on a trailing end of the container threads, and the resilient tab is located on the container, and wherein the threads are concentric with a central axis of the opening and the locking tab extends in a plane orthogonal to that axis, with an end of the locking tab ending in substantial alignment with the shaped locking end.

16. The locking cap and container of claim 1, wherein the barb and shaped end abut along a surface inclined relative to a longitudinal thread axis.

17. The locking cap and container of claim 7, wherein the barb and shaped end abut along a surface inclined relative to a longitudinal thread axis.

18. The locking cap and container of claim 1, wherein the threads comprise screw threads and at least one of the shaped end and a mating portion of the barb are orthogonal to a screw thread axis along a crest of the screw thread on which the shaped end is located.

19. The locking cap and container of claim 7, wherein the threads comprise screw threads and at least one of the shaped end and a mating portion of the barb are orthogonal to a screw thread axis along a crest of the screw thread on which the shaped end is located.

20. The locking cap and container of claim 1, wherein the threads comprise screw threads and at least one of the shaped distal end and a mating portion of the barb is inclined at an angle to a screw thread axis along a crest of the screw thread on which the shaped end is located, with the angle being selected to cause the shaped end to further engage the barb.

21. The locking cap and container of claim 1, wherein the threads comprise screw threads and the locking tab is located below the at least one shaped end a distance slightly less than a root width of the at least one screw thread which contains the barb and measured at a location just trailing an end of the barb.

22. The locking cap and container of claim 1, wherein the locking tab is on a trailing end of a container thread.

23. A releasable locking cap and container where the container has an opening surrounded by a peck with at least one container thread thereon that is sized and located to threadingly engage at least one cap thread formed on a skirt of the cap, the container having a longitudinal axis, comprising:

first means formed on at least one of the cap or container thread and second means formed on the other of the at least one cap or container thread, the means aligning to form a lock restraining rotation of the cap in one direction when the means are aligned and allowing relative rotation along the one direction and opposite the one direction when the means are not aligned;

a resilient locking tab extending from one of the skirt of the cap or on the container neck located to abut something on the other of the skirt or container neck and thereby generate a resilient force to urge the second means into overlapping rotational alignment with the first means the locking tab extending along said first and second means so a line parallel to the longitudinal axis intersects the locking the first and second means and the locking tab when the means are aligned to form the lock.

24. The locking cap and container of claim 23, wherein the first means is on the skirt of the cap.

25. The locking cap and container of claim 23, wherein the first means is on the container and the locking tab extends from the container.

26. The locking cap and container of claim 25, wherein the locking tab comprises a plurality of thin flanges extending outward from the container.

27. The locking cap and container of claim 23, wherein the tab extends from one of two parallel and vertically adjacent screw threads.

28. The locking cap and container of claim 23, wherein the first and second means comprise abutting surfaces orthogonal to a screw thread axis along a crest of the at least one screw thread on which one of the first and second means is located.

29. The locking cap and container of claim 23, wherein the first and second means comprise abutting surfaces inclined at an angle to a screw thread axis along a crest of the screw thread on which one of the first and second means is located, with the angle being selected to cause the first means to further engage the second means.

30. The locking cap and container of claim 23, wherein the first and second means are at or adjacent to an end of the respective at least one screw thread on which the first and second means are formed.

31. The locking cap and container of claim 23, wherein the locking tab has a trailing end and the first and second means each have a leading end and a trailing end and the trailing end of the locking tab is aligned with a leading end of at least one of the first and second means when the cap is locked on the container.

32. A method for releasably locking a cap on a container having an opening with at least one container thread located on a neck of the container adjacent the opening, the thread being sized and located to threadingly engage at least one cap thread formed on a skirt of the cap, comprising:

providing one of the cap or container threads with a barb extending from the thread;

providing the other of the cap or container thread with a locking end located adjacent the barb when the cap is locked on the container;

engaging the at least one cap and container threads and providing relative rotation in a first direction between the cap and body to tighten the cap on the container and to align the barb with the locking end; and resiliently urging the barb into overlapping alignment with the locking end a distance sufficient that the barb and locking end engage if the direction of the relative rotation is reversed, the resilient urging being provided by a resilient locking tab extending from one of the container or the skirt of the cap, the locking tab being spaced apart from and extending along a length of an adjacent thread a distance to permit a thread on the other of the container or cap from which the barb extends to pass between the locking tab and the thread while being resiliently urged against the adjacent thread.

33. The method of claim 32, wherein the barb is located on the skirt of the cap and the locking end is located on the container.

34. The method of claim 32, wherein the barb is on a leading end of a cap screw thread and the resilient member extends from the container below a trailing end of a container screw thread.

35. The method of claim 34, wherein the threads comprise screw threads barb advances between the trailing end of the screw thread and the locking tab when the barb is advanced in the first direction.

36. The method of claim 32, wherein the threads comprise screw threads and the barb and locking tab are located on the container and the distal end is located on the skirt of the cap.

37. The method of claim 32, wherein the threads comprise screw threads and the locking tab is located at least in part between two adjacent, parallel screw threads.

38. The method of claim 37, farther comprising pushing down on the cap to move the thread containing the barb against the locking tab a distance sufficient to move the barb and distal end out of alignment, and providing relative rotation between the cap and container to move the barb in a direction opposite the first direction so the barb can pass the distal end and move along a bottom of the thread on which the distal end is provided.

39. The method of claim 33, farther comprising pushing down on the cap to move the thread containing the barb against the locking tab a distance sufficient to move the barb and distal end out of alignment, and providing relative rotation between the cap and container to move the barb in a direction opposite the first direction so the barb can pass the distal end and move along a bottom of the thread on which the distal end is provided.

40. A releasable locking cap and container where the container has an opening with at least one container thread adjacent the opening with the thread sized and located to threadingly engage at least one cap thread formed on a skirt of the cap, comprising:

a shaped end on at least one of the cap or container thread and a barb on the other of the at least one cap or container thread, the barb being on a leading end of the thread;

a resilient locking tab extending from one of the cap's skirt or container, the locking tab being spaced apart from the shaped end a distance sufficient to allow passage of the barb beyond the shaped end but sufficiently close to resiliently urge the barb into overlapping rotational alignment with the shaped end, the shaped end being configured to lockingly engage the barb;

wherein the threads comprise screw threads and the locking tab is located below the at least one shaped end a distance slightly less than a root width of the at least one screw thread which contains the barb and measured at a location just trailing an end of the barb.

41. A releasable locking cap and container where the container has an opening with at least one container thread adjacent the opening with the thread sized and located to threadingly engage at least one cap thread formed on a skirt of the cap, comprising:

a shaped end on at least one of the cap or container thread and a barb on the other of the at least one cap or container thread, the barb being on a leading end of the thread;

a resilient locking tab extending from one of the cap's skirt or container, the locking tab being spaced apart from the shaped end a distance sufficient to allow passage of the barb beyond the shaped end but sufficiently close to resiliently urge the barb into overlapping rotational alignment with the shaped end, the shaped end being configured to lockingly engage the barb, wherein the locking tab is on a trailing end of a container thread.

42. A method for releasably locking a cap on a container having an opening with at least one container thread located on a neck of the container adjacent the opening, the thread being sized and located to threadingly engage at least one cap thread formed on a skirt of the cap, comprising:

providing one of the cap or container threads with a barb extending from the thread;

providing the other of the cap or container thread with a locking end located adjacent the barb when the cap is locked on the container;

engaging the at least one cap and container threads and providing relative rotation in a first direction between the cap and body to tighten the cap on the container and to align the barb with the locking end; and resiliently urging the barb into overlapping alignment with the locking end a distance sufficient that the barb and locking end engage if the direction of the relative rotation is reversed, the resilient urging being provided by a resilient locking tab extending from one of the container or the skirt of the cap, the locking tab being spaced apart from an adjacent thread a distance to permit a thread on the other of the container or cap from which the barb extends to pass between the locking tab and the thread while being resiliently urged against the adjacent thread, wherein the threads comprise screw threads and the locking tab is located at least in part between two adjacent, parallel screw threads.

43. The locking cap and container of claim 1, wherein the locking tab extends from the same container or cap as does the shaped end and extends a distance of about ⅛ to ⅓ the length of the nearest thread on that same container or cap.

* * * * *